US007681648B2

(12) United States Patent
Ring

(10) Patent No.: US 7,681,648 B2
(45) Date of Patent: Mar. 23, 2010

(54) METHOD OF MONODIAMETER WELL CONSTRUCTION

(75) Inventor: Lev Ring, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 105 days.

(21) Appl. No.: 11/872,120

(22) Filed: Oct. 15, 2007

(65) Prior Publication Data

US 2008/0087440 A1 Apr. 17, 2008

Related U.S. Application Data

(60) Provisional application No. 60/829,374, filed on Oct. 13, 2006.

(51) Int. Cl.
*E21B 19/16* (2006.01)

(52) U.S. Cl. ..... 166/380; 166/207; 166/277

(58) Field of Classification Search ..... 166/207, 166/212, 217, 277, 378, 380, 383, 384
See application file for complete search history.

(56) References Cited

U.S. PATENT DOCUMENTS

| | | | | |
|---|---|---|---|---|
| 2,796,134 | A * | 6/1957 | Binkley | 166/387 |
| 5,271,472 | A * | 12/1993 | Leturno | 175/107 |
| 7,004,264 | B2 * | 2/2006 | Simpson et al. | 175/57 |
| 7,066,284 | B2 * | 6/2006 | Wylie et al. | 175/65 |
| 7,077,210 | B2 * | 7/2006 | MacKay et al. | 166/380 |
| 7,225,523 | B2 * | 6/2007 | Metcalfe | 29/507 |
| 7,287,603 | B2 * | 10/2007 | Hay et al. | 175/57 |
| 2003/0217865 | A1 | 11/2003 | Simpson et al. | |
| 2004/0079534 | A1 | 4/2004 | Harrall et al. | |
| 2004/0216925 | A1 * | 11/2004 | Metcalfe et al. | 175/57 |
| 2004/0221996 | A1 * | 11/2004 | Burge | 166/380 |
| 2004/0256112 | A1 * | 12/2004 | Harrall et al. | 166/380 |
| 2005/0138790 | A1 | 6/2005 | Cook et al. | |
| 2005/0217866 | A1 | 10/2005 | Watson et al. | |
| 2005/0269108 | A1 * | 12/2005 | Whanger et al. | 166/384 |
| 2006/0016597 | A1 * | 1/2006 | Emerson | 166/277 |
| 2006/0185857 | A1 * | 8/2006 | York et al. | 166/384 |
| 2006/0283607 | A1 * | 12/2006 | Duggan et al. | 166/387 |

FOREIGN PATENT DOCUMENTS

| | | |
|---|---|---|
| GB | 2 428 721 | 2/2007 |

OTHER PUBLICATIONS

GB Search Report, Application No. GB0720005.8, dated Jan. 31, 2008.
CA Office Action, Application No. 2,606,620 dated May 8, 2009.

* cited by examiner

*Primary Examiner*—Jennifer H Gay
*Assistant Examiner*—Blake Michener
(74) *Attorney, Agent, or Firm*—Patterson & Sheridan, L.L.P.

(57) ABSTRACT

A method and apparatus for completing a well through expansion of tubing enable construction of the well or at least part of the well with a mono-diameter or substantially no inside diameter reduction with subsequent casings/liners. Prior to lining an extended section of the borehole, forming a discrete enlarged portion of the extended section with a relatively larger inner diameter than the remainder of the extended section of the borehole occurs where overlapping tubing sections are to be located. For some embodiments, an open-hole clad expanded in the enlarged portion of the extended section of the borehole provides an inner surface for receiving a bottom of a first expanded liner and optionally a top of a second expanded liner.

16 Claims, 4 Drawing Sheets

METHOD OF MONODIAMETER WELL CONSTRUCTION

CROSS-REFERENCE TO RELATED APPLICATIONS

This application claims benefit of U.S. provisional patent application Ser. No. 60/829,374, filed Oct. 13, 2006, which is herein incorporated by reference.

BACKGROUND OF THE INVENTION

1. Field of the Invention

Embodiments of the invention generally relate to well completion through expansion of tubing.

2. Description of the Related Art

Forming a hydrocarbon well begins by drilling into the earth to establish a borehole. Lining the borehole with steel pipe called casing provides support to the borehole and facilitates the isolation of certain areas of the well adjacent hydrocarbon bearing formations. The casing may extend down the borehole from the surface of the well with the annular area between the outside of the casing and the borehole filled with cement to permanently set the casing in the well. As the well is drilled to a new further depth, additional tubing or liner overlaps the lower portion of a previous casing once the liner is run into the well and installed within the region below the previous casing.

Stepwise reduction in internal diameter occurs with each subsequent string of liner or casing unless the subsequent strings are expanded in place. Several techniques enable expansion of wellbore tubing in situ. For example, applying hydraulic pressure to an inside of the tubing to be expanded and/or urging a mandrel, a rotary expander tool or a cone-shaped member through the tubing to be expanded may accomplish the expansion. Even though the tubing may be expanded, the overlap between two strings continues to create challenges in order to achieve a mono-diameter well. Procedures accounting for the double tubing wall thickness and any hangers at the overlap require implementing difficult expansion techniques and/or utilizing applications with expensive and problematic approaches.

Therefore there exists a need for improved methods and apparatus of constructing a mono-diameter well.

SUMMARY OF THE INVENTION

Embodiments of the invention generally relate to a method of completing a well including drilling a borehole extension with a first diameter beyond a cased section of the well, forming an enlarged portion of the borehole extension with a second diameter larger than the first diameter, wherein the enlarged portion is spaced from an end of the cased section, disposing a clad within the enlarged portion of the borehole extension, and coupling a liner between the clad and the cased section.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention relate to completing a well through expansion of tubing to enable construction of the well or at least part of the well with a mono-diameter or substantially no inside diameter reduction with subsequent casings/liners. Prior to lining an extended section of the borehole, forming a discrete enlarged portion of the extended section with a relatively larger inner diameter than the remainder of the extended section of the borehole occurs where overlapping tubing sections are to be located. For some embodiments, an open-hole clad expanded in the enlarged portion of the extended section of the borehole provides an inner surface for receiving a bottom of a first expanded liner and optionally a top of a second expanded liner.

Figure 1:
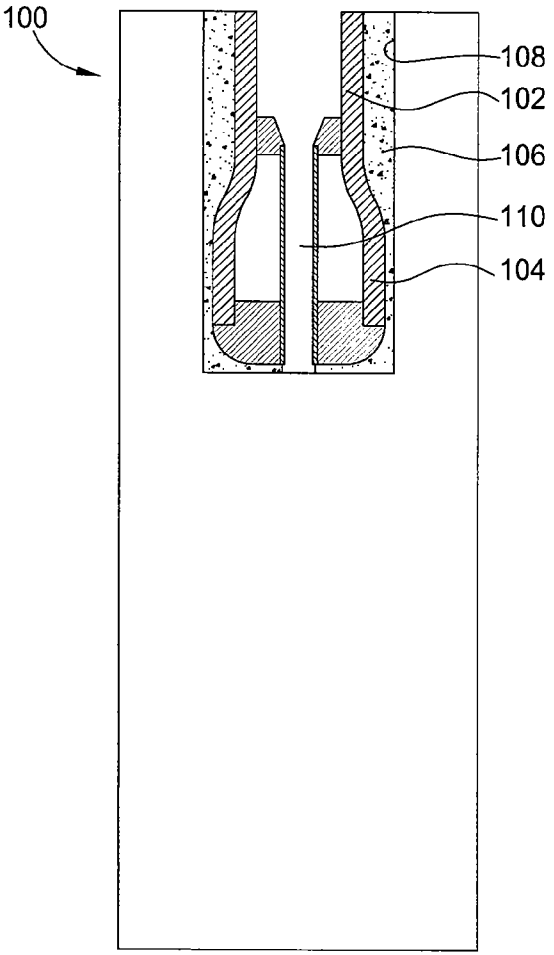
FIG. 1 is a sectional view of a well having a casing string with an oversized shoe for accepting a top end of a first liner installed according to embodiments of the invention.

FIG. 1 shows a well 100 having a casing string 102 with an oversized shoe 104. The shoe 104 defines an enlarged inner diameter at a bottom end of the casing string 102. Cement 106 pumped through the shoe 104 into an annulus between the casing string 102 and a borehole 108 secures the casing string 102 within the well 100. An isolated flow path 110 through the shoe 104 may protect the enlarged inner diameter from accumulation of cement during flowing of the cement 106 into the annulus.

Figure 2:
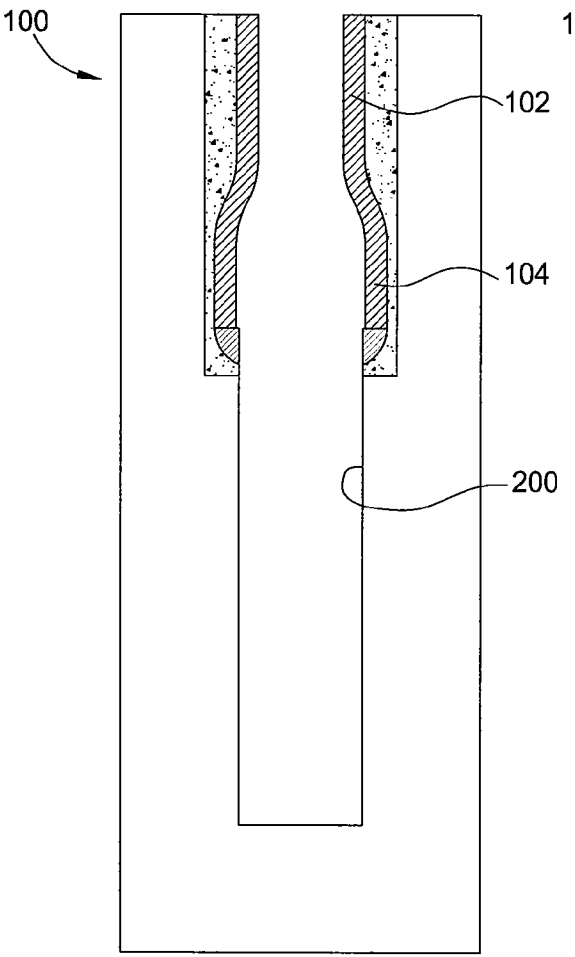
FIG. 2 is a sectional view of the well upon drilling out of the oversized shoe and further drilling of a borehole extension beyond a bottom end of the casing string.

FIG. 2 illustrates the well 100 upon drilling out of the shoe 104 and further drilling of a borehole extension 200 beyond a bottom end of the casing string 102. An inner diameter of the borehole extension 200 substantially matches the enlarged inner diameter of the shoe 104. Examples of drill bits suitable for drilling the borehole extension 200 after passing through the casing string 102 include bi-center bits and extendable bits. Drilling may commence until reaching a target depth or until formation conditions or changes necessitate lining off the open portion of the well 100.

Figure 3:
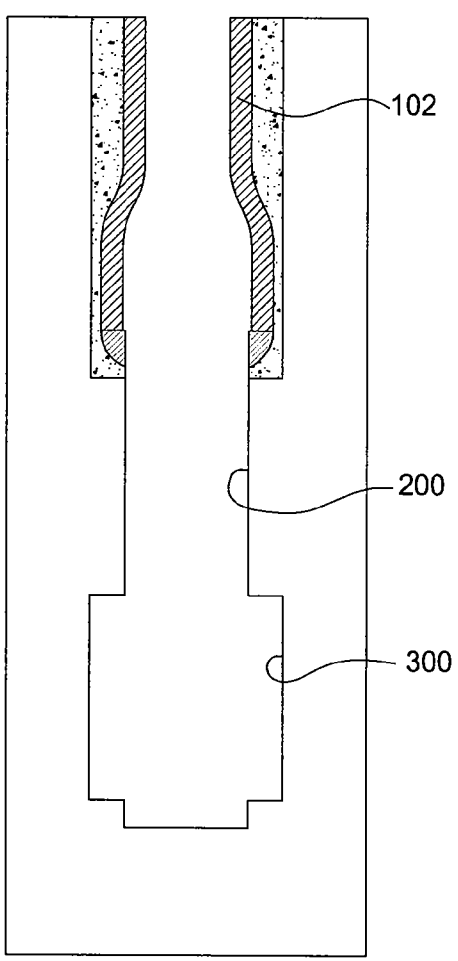
FIG. 3 is a sectional view of the well after underreaming an enlarged portion of the borehole extension spaced from the bottom end of the casing string.

FIG. 3 shows the well following underreaming of an enlarged portion 300 of the borehole extension 200 once determined that lining of the open portion of the well 100 should occur in reaction to some problem, such as a formation pressure fluctuation, or due to reaching the target depth. Underreaming the enlarged portion 300 of the borehole extension 200 spaced from the bottom end of the casing string 102 provides a larger inside diameter than at an intermediate portion of the borehole extension 200 between the bottom end of the casing string 102 and the enlarged portion 300. Depending on the length of the borehole extension 200 to be clad as described herein, the enlarged portion 300 may occupy about 45 meters to about 60 meters of a previously drilled section of the borehole extension 200. Forming a majority of the borehole extension 200 below the casing string smaller in diameter relative to the enlarged portion 300 facilitates accurate directional drilling since accuracy in orienting increases with decreasing hole diameter. A span of the borehole extension 200 to be lined determines location of the enlarged portion 300, which may be at a bottom area of the borehole extension 200.

Figure 4:
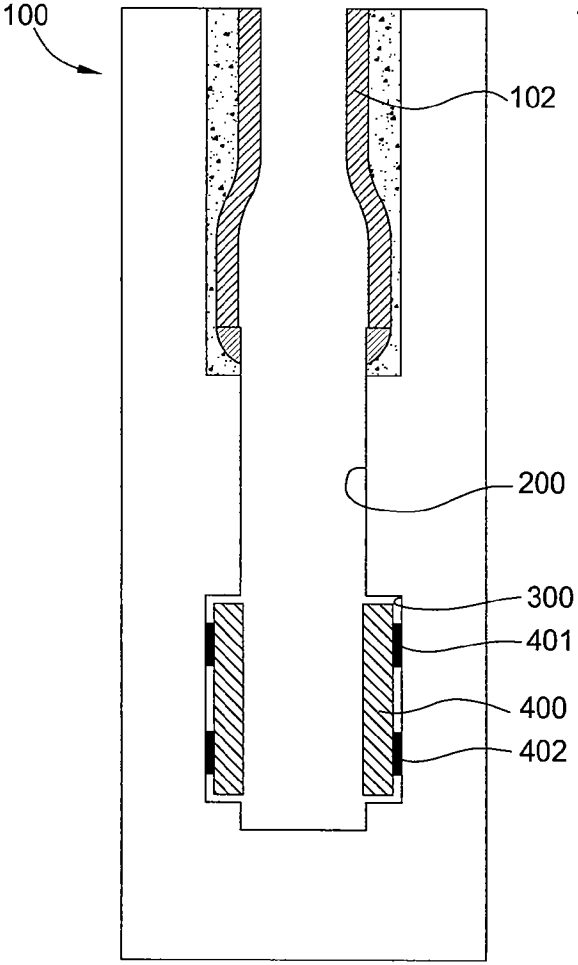
FIG. 4 is a sectional view of the well with an open-hole clad disposed in the enlarged portion of the borehole.

FIG. 4 illustrates the well 100 with an open-hole clad 400 disposed in the enlarged portion 300 of the borehole extension 200. Installation of the clad 400 involves reconfiguring/expanding the clad 400 at the enlarged portion 300 since the initial outer dimension of the clad must permit passing of the clad 400 through restrictions such as the casing 102 and the borehole extension 200 above the enlarged portion 300. Once installed, the inner diameter of the open-hole clad 400 may substantially match the diameter of a remainder of the borehole extension 200 that is still open-hole and is not underreamed to provide the enlarged portion 300. In some embodiments, part or all of the inner diameter may be greater or lesser than that of the borehole extension 200 depending upon requirements of the situation. The open-hole clad 400 may include an upper seal 401 and a lower seal 402 disposed around an outer surface of the clad 400 proximate each end of the clad 400 to seal fluid flow from a surrounding formation. The seals, 401, 402 may be adapted to swell in presence of certain fluids in order to ensure effectiveness. Further, the seals 401, 402 create zonal isolation between tubing strings extending above and below the clad 400 (see, FIG. 6) by sealing an annulus between the clad 400 and the enlarged portion 300 of the borehole extension 200. In some embodiments, the clad 400 may be sealed against the enlarged portion 300 by cement or any other hardenable substance (e.g., epoxy).

Figure 5:
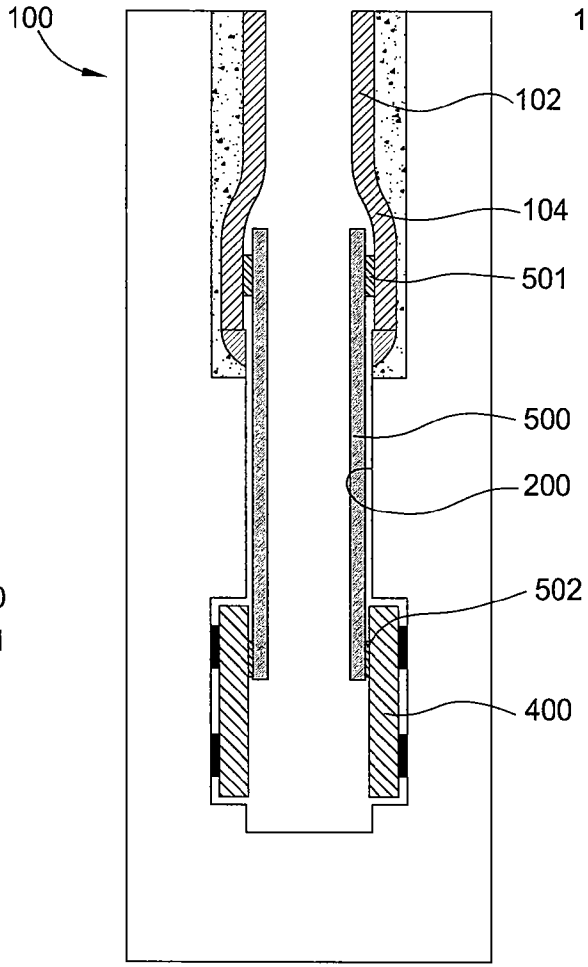
FIG. 5 is a sectional view of the well following installation of a first open-hole liner string between the open-hole clad and the oversized shoe of the casing string.

FIG. 5 shows the well 100 following installation of a first liner 500 between the open-hole clad 400 and the oversized shoe 104 of the casing string 102. Installation of the first liner 500 may involve expansion/reconfiguration of the first liner 500 to have an inner diameter at least as large as a drift diameter of the casing string 102. Upon expansion, an outside of the first liner 500 may contact an inside surface of the shoe 104 and an inside surface of the clad 400 at respective ends of the first liner 500. For some embodiments, the contact provides sealing interaction which may be aided by an upper seal/hanging arrangement or formation 501 around a top end of the first liner 500 and a lower seal 502 circumscribing a bottom end of the first liner 500. A cementing operation, in some embodiments, fills the annulus between the first liner 500 and the borehole extension 200 with cement. The first liner 500 may lack overlap with all of the clad 400 leaving a lower inside surface of the clad 400 open. For some embodiments, the well 100 may not include the clad 400 such that the first liner 500 is expanded into the open-hole of the enlarged portion 300 of the borehole extension 200.

Figure 6:
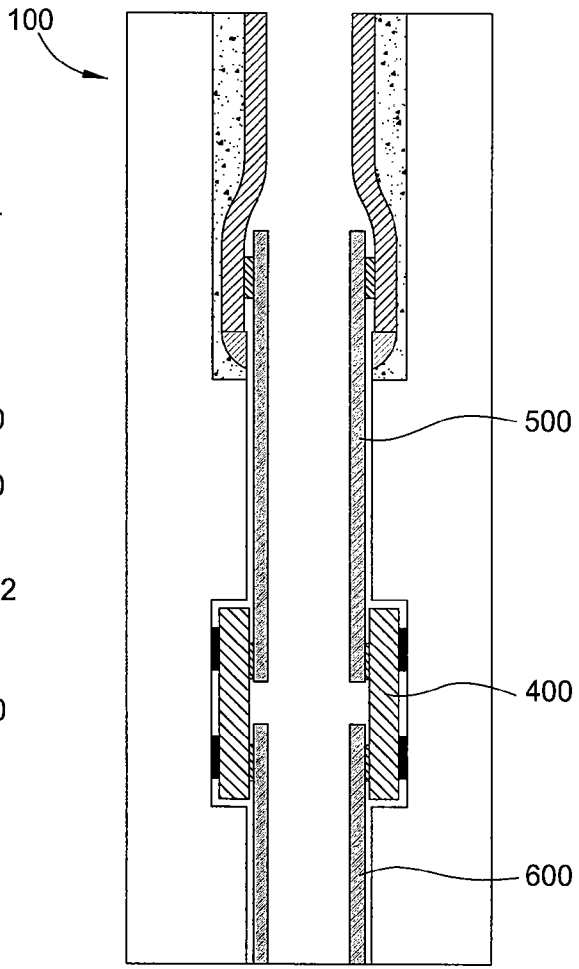
FIG. 6 is a sectional view of the well subsequent to addition of a second liner extending below the open-hole clad illustrating construction of the well with a mono-diameter utilizing as many liner strings as needed and repeating procedures depicted in FIGS. 2-5.

FIG. 6 illustrates the well 100 subsequent to addition of a second liner 600 extending below the open-hole clad 400 with a top portion of the second liner 600 disposed against the lower inside surface of the clad 400. The second liner 600 installation may include the same or similar procedure as used with installation of the first liner 500 to maintain a mono-diameter profile of the well 100. The second liner 600 may extend to an additional clad (not shown), which may have been installed in accordance with procedures that are the same or similar as utilized with respect to the clad 400. Any tubing, such as joints that are solid walled, slotted, perforated, and/or expandable sand screen may form the liners 500, 600. Further, terms "liner", "clad," and "casing" as used herein include any customary definitions for such terms and shall refer to any tubing with at least sections surrounded by or cemented in an open-hole borehole. Based on the foregoing, utilizing as many liner strings, such as the liners 500, 600, as needed and repeating procedures depicted in FIGS. 2-5 enables construction of the well 100 to any depth with a mono-diameter.

Figure 7:
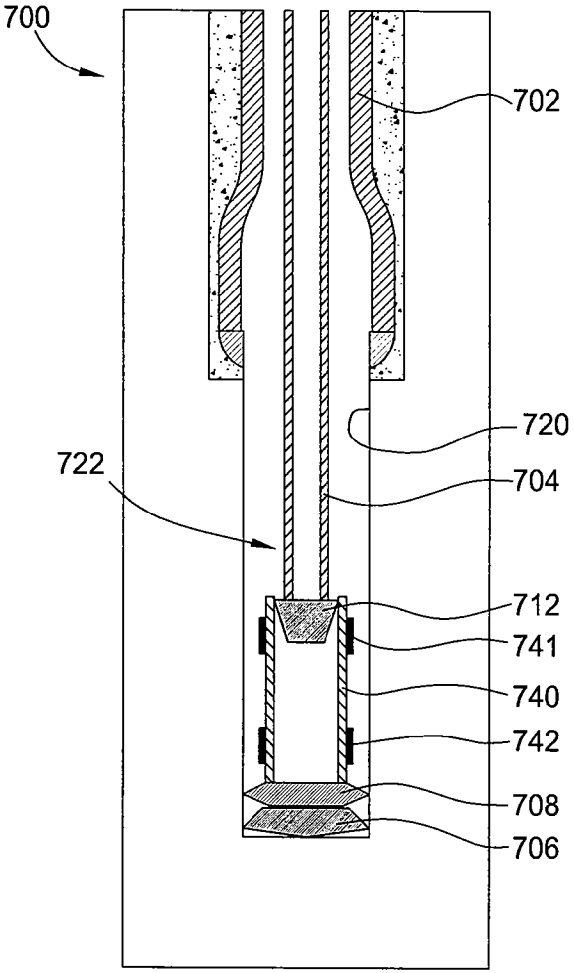
FIG. 7 is a sectional view of a well upon further drilling of a borehole extension beyond a bottom end of a casing string utilizing an assembly for drilling with an open-hole clad.

FIG. 7 shows a well 700 upon further drilling of a borehole extension 720 beyond a bottom end of a casing string 702 utilizing an assembly 722 for drilling with an open-hole clad 740. For some embodiments, the assembly 722 includes a drill string 704 conveying a drill bit 706, an underreamer 708, the open-hole clad 740, and an expander tool 712. The expander tool 712 disposed on the drill string 704 may couple in a releasable manner to the clad 740 with the drill bit 708 coupled also in a releasable manner to the bottom end of the clad 740 such that rotation and axial movement of the drill string 704 advances the drill bit 706 through the formation. Rotation may be achieved using a mud motor disposed below or above the clad 740. The underreamer 708 and drill bit 706 may form separate tools or one integrated component that drills identified diameter boreholes as described herein. The assembly 722 consolidates various procedures in one run without requiring additional trips for each procedure by including multiple tools/tubing in one work-string. However, any one or more of the underreamer 708, the open-hole clad 740, and the expander tool 712 may be run-in on separate trips. The assembly 722 may include a first liner (see, FIG. 5) also coupled to the drill string 704 with the open-hole clad 740 to further reduce additional trip requirements.

Figure 8:
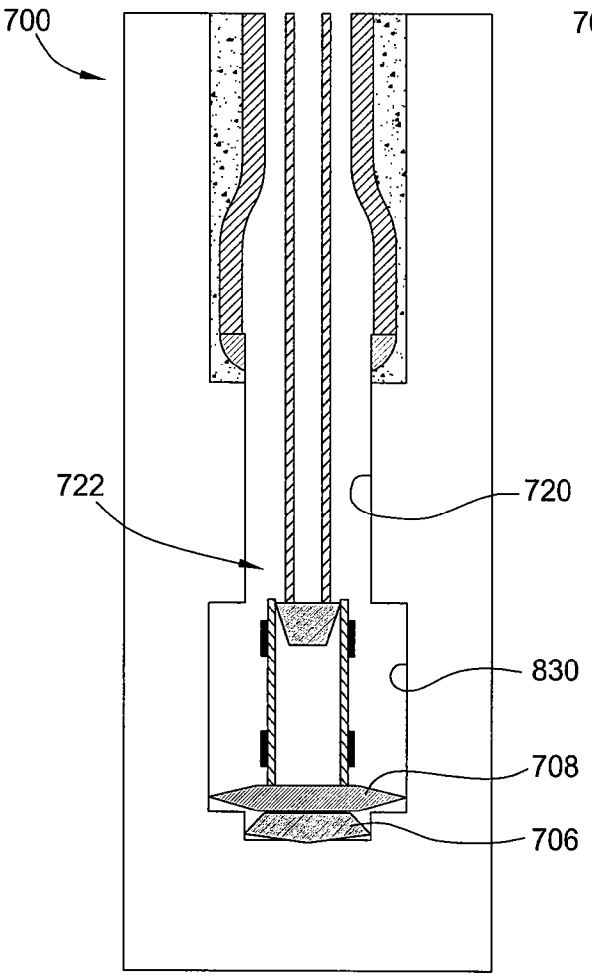
FIG. 8 is a sectional view of the well shown in FIG. 7 after underreaming an enlarged portion of the borehole extension with an underreamer of the assembly.

FIG. 8 illustrates underreaming an enlarged portion 830 of the borehole extension 720 with the underreamer 708 of the assembly 722. The underreaming may occur, for example, utilizing the underreamer 708 across a previously drilled section of the borehole extension 720 created with the drill bit 706. The underreamer 708 may extend to enable cutting of the annular space associated with the enlarged portion 830. For some embodiments, the drill bit 706 may provide an extended position corresponding to the enlarged portion 830 such that the enlarged portion 830 is drilled by the drill bit 706 in one pass without requiring use of the underreamer 708.

Figure 9:
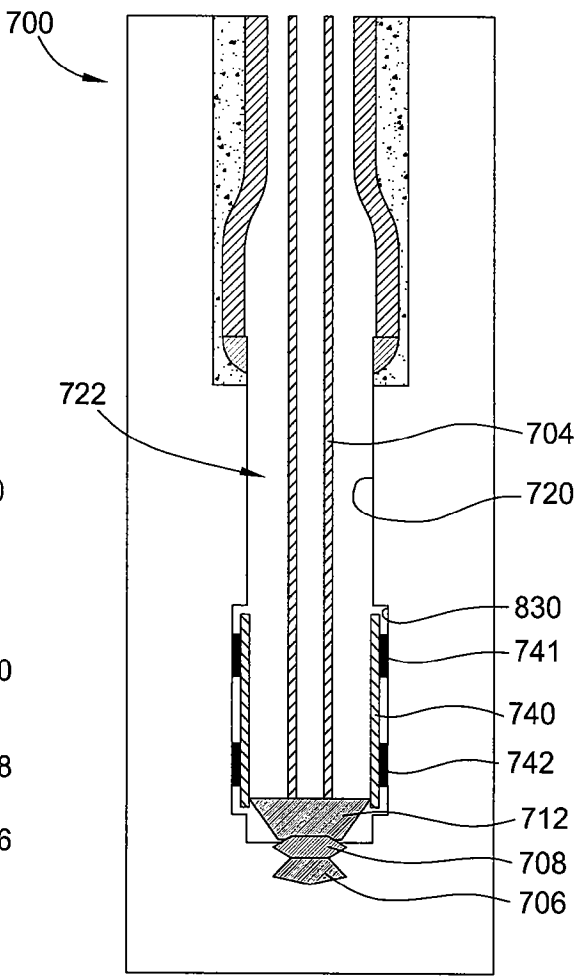
FIG. 9 is a sectional view of the well following expansion of the open-hole clad with an expansion tool of the assembly.

FIG. 9 shows expanding of the open-hole clad 740 with the expansion tool 712 of the assembly 722. In operation, the expansion tool 712 actuates to an extended position for enlarging the inside of the clad 740. Expansion along a further length of the clad 740 may occur by pushing with the drill string 704 once the expander tool 712 is released from the clad 740. Upper and lower sealing elements 741, 742 around the clad 740 may contact the enlarged portion 830 of the borehole extension 720 once the expansion tool traverses through the clad 740. After complete expansion of the clad 740 resulting in release of the underreamer 708 and the bit 706 from the clad 740, latching couples the underreamer 708 and the bit 706 to the drill string 704 for retrieval. Completion of the well 700 may continue in conformance with FIGS. 5 and 6 as previously described.

Figure 10:
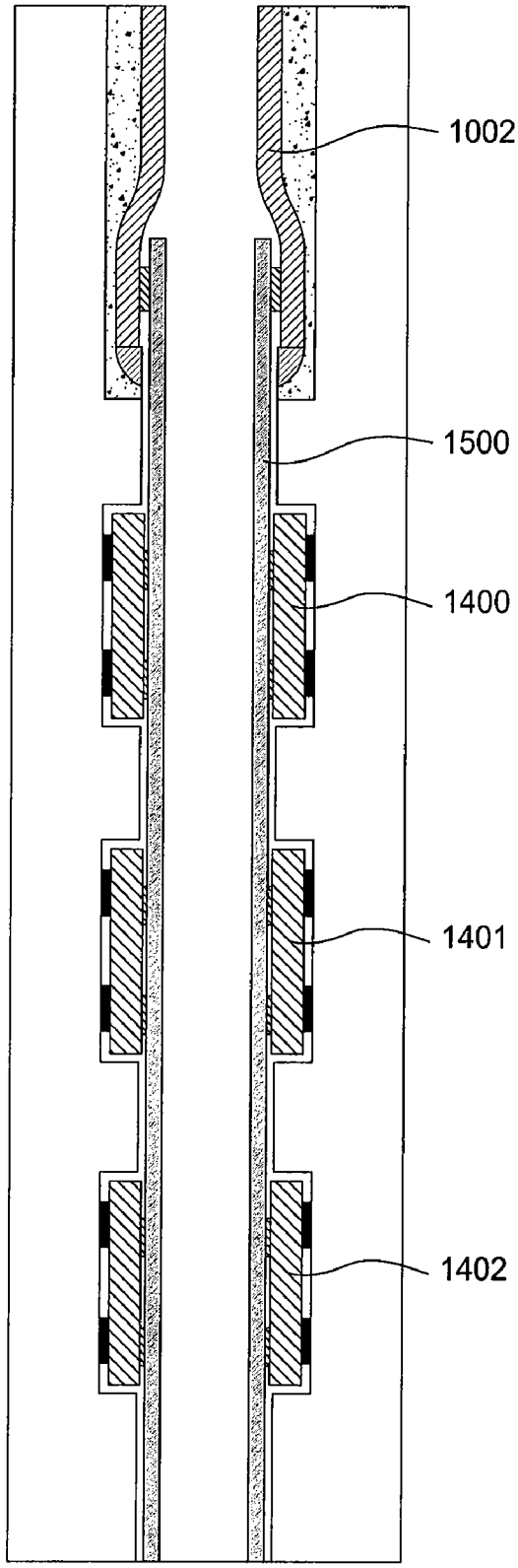
FIG. 10 is a sectional view of a well following expansion of multiple open-hole clads with a liner spanning the clads that enable zonal isolation of regions between the clads.

FIG. 10 shows a well following expansion of first, second and third open-hole clads 1400, 1401, 1402 with a liner 1500 spanning the clads 1400, 1401, 1402 that enable zonal isolation of regions between the clads 1400, 1401, 1402. As described herein, the clads 1400, 1401, 1402 may be disposed in discrete enlarged regions of openhole below a casing 1002 within the well. For some embodiments, an end of the liner 1500 couples to the casing 1002. Any aspects described herein may be implemented with respect to utilizing the clads 1400, 1401, 1402 and the liner 1002 that may be perforated only between select ones of the clads 1400, 1401, 1402.

While the foregoing is directed to embodiments of the present invention, other and further embodiments of the invention may be devised without departing from the basic scope thereof, and the scope thereof is determined by the claims that follow.

What is claimed is:

1. A method of completing a well, comprising:

drilling a borehole extension with a first diameter beyond a cased section of the well;

forming an enlarged portion of the borehole extension with a second diameter larger than the first diameter, wherein the enlarged portion is spaced from an end of the cased section;

disposing and expanding a clad within the enlarged portion of the borehole extension such that a seal member on an outside surface of the clad creates a seal with the enlarged portion; and disposing and expanding a liner between the clad and the cased section such that a first seal member proximate one end of the liner forms a seal with the clad and a second seal member proximate another end of the liner forms a seal with the cased section, wherein an inside diameter of the liner is at least as large as a minimum inside diameter of the cased section after expansion of the liner.

2. The method of claim 1, wherein disposing the clad includes expanding the clad to have an inside diameter substantially matching the first diameter.

3. The method of claim 1, further comprising coupling an additional tubing string spaced from the liner to an inside surface of the clad.

4. The method of claim 1, further comprising coupling an additional tubing string spaced from the liner to an inside surface of the clad, wherein the additional tubing string extends beyond the clad in a direction away from the liner.

5. The method of claim 1, wherein drilling the borehole extension and forming the enlarged portion of the borehole extension occurs in a single trip.

6. The method of claim 1, wherein drilling the borehole extension, forming the enlarged portion of the borehole extension, and disposing the clad all occur in a single trip.

7. The method of claim 1, wherein drilling the borehole extension, forming the enlarged portion of the borehole extension, and disposing and expanding the clad all occur in a single trip.

8. The method of claim 1, further comprising enlarging another section of the borehole extension below the clad and disposing additional cladding therein.

9. The method of claim 1, wherein the cased section includes a shoe having an enlarged inner diameter.

10. The method of claim 9, further comprising drilling through the shoe, thereby exposing the enlarged inner diameter.

11. The method of claim 10, wherein a portion of the liner is disposed in the enlarged inner diameter of the shoe.

12. The method of claim 9, wherein drilling through the shoe, drilling the borehole extension, forming the enlarged portion of the borehole extension, and disposing and expanding the clad all occur in a single trip.

13. The method of claim 1, wherein drilling the borehole extension, forming the enlarged portion of the borehole extension, disposing and expanding the clad and disposing and expanding the liner all occur in a single trip.

14. The method of claim 1, wherein the seal member on an outside surface of the clad is configured to swell in the presence of a predetermined fluid.

15. A method of completing a well, comprising:

disposing a clad within a first section of an unlined length of the well, wherein the clad once disposed in the first section has a greater outer diameter than an inner diameter at a location along at least one of a cased length of the well and a second section of the unlined length of the well separating the clad from the cased length of the well; and disposing and expanding a liner between the clad and casing within the cased length of the well such that a first seal member proximate one end of the liner forms a seal with the clad and a second seal member proximate another end of the liner forms a seal with cased length of the well, wherein an inside diameter of the liner is at least as large as a minimum inside diameter of the cased section after expansion of the liner.

16. The method of claim 15, wherein coupling the liner includes sealing an outside of the liner with an inside surface of the casing and an inside surface of the clad.

* * * * *